US005715561A

United States Patent [19]

Tuthill et al.

[11] Patent Number: 5,715,561

[45] Date of Patent: Feb. 10, 1998

[54] PERSONAL CLEANSING IMPLEMENT MADE OF STRETCHED SCRIM PROVIDING SOFTNESS BENEFIT

[75] Inventors: Lyle B. Tuthill, Indian Hill; Charles G. Yeazell; Richard M. Girardot, both of Cincinnati, all of Ohio

[73] Assignee: The Procter & Gamble Company, Cincinnati, Ohio

[21] Appl. No.: 631,588

[22] Filed: Apr. 12, 1996

[51] Int. Cl.[6] ..... A47L 13/10; A47L 17/08

[52] U.S. Cl. ..... 15/229.11; 15/209.1

[58] Field of Search ..... 15/118, 208, 209.1, 15/229.11, 229.12, 229.13; 428/36.1, 152, 255

[56] References Cited

U.S. PATENT DOCUMENTS

| | | | |
|---|---|---|---|
| 1,533,868 | 4/1925 | Kingman . | |
| 1,659,977 | 2/1928 | Kingman . | |
| 1,689,207 | 10/1928 | Kingman . | |
| 1,794,854 | 3/1931 | Kean . | |
| 1,865,785 | 7/1932 | Parker . | |
| 1,963,529 | 6/1934 | Protz . | |
| 2,006,708 | 7/1935 | Benedict . | |
| 2,151,448 | 3/1939 | Steinberg . | |
| 2,601,771 | 7/1952 | Cameron . | |
| 2,857,610 | 10/1958 | Rympalski . | |
| 2,940,100 | 6/1960 | Grossmeyer . | |
| 3,169,264 | 2/1965 | Walker . | |
| 3,241,171 | 3/1966 | Benjamin et al. . | |
| 3,520,016 | 7/1970 | Meitner | 428/152 |
| 3,711,889 | 1/1973 | Jennings . | |
| 3,772,728 | 11/1973 | Johnson . | |
| 3,778,172 | 12/1973 | Myren . | |
| 3,917,889 | 11/1975 | Gaffney et al. . | |
| 3,957,565 | 5/1976 | Livingston et al. . | |
| 3,977,452 | 8/1976 | Wright . | |
| 4,017,949 | 4/1977 | Botvin . | |
| 4,020,208 | 4/1977 | Mercer et al. . | |
| 4,040,139 | 8/1977 | Botvin . | |
| 4,052,238 | 10/1977 | Botvin . | |
| 4,057,449 | 11/1977 | Livingston et al. . | |
| 4,059,713 | 11/1977 | Mercer | 428/36.1 |
| 4,123,491 | 10/1978 | Larsen . | |
| 4,144,612 | 3/1979 | Yamaguchi . | |
| 4,152,479 | 5/1979 | Larsen . | |
| 4,154,542 | 5/1979 | Rasmason . | |
| 4,168,863 | 9/1979 | Hatcher . | |
| 4,174,416 | 11/1979 | Mercer | 428/36.1 |
| 4,196,490 | 4/1980 | Jonzon . | |
| 4,206,948 | 6/1980 | Shimizu . | |
| 4,287,633 | 9/1981 | Gropper . | |
| 4,343,061 | 8/1982 | Hanazono . | |
| 4,457,640 | 7/1984 | Anderson . | |
| 4,462,135 | 7/1984 | Sanford . | |
| 4,473,611 | 9/1984 | Haq . | |
| 4,651,505 | 3/1987 | Gropper . | |

(List continued on next page.)

FOREIGN PATENT DOCUMENTS

| | | | |
|---|---|---|---|
| 0086355 | 1/1983 | European Pat. Off. . | |
| 2287886 | 5/1976 | France | 15/209.1 |
| 29 34 293 A1 | 8/1979 | Germany . | |
| 1308904 | 7/1973 | United Kingdom . | |
| 1473147 | 9/1974 | United Kingdom . | |
| 2237196 | 5/1991 | United Kingdom . | |

*Primary Examiner*—Terrence Till
*Attorney, Agent, or Firm*—Ronald W. Kock

[57] ABSTRACT

A personal cleansing implement is made from a hydrophobic piece of tubular scrim. The piece of tubular scrim is gathered along a longitudinal axis thereof to form circumferential pleats. The circumferential pleats are permanently fixed in a gathered condition by bonding together a top surface and a bottom surface of them adjacent to their perimeter while they are maintained in the gathered condition. The tubular scrim have properties which result in a consumer preferred softness in the personal cleansing implement. The properties of the tubular scrim comprise a node width ranging from 0.18 mm to 0.56 mm; a strand length ranging from 1.78 mm to 3.68 mm; and a repeat unit average weight ranging from $1.0\times10^{-4}$ gm to $3.4\times10^{-4}$ gm. The tubular scrim is preferably made substantially of low density polyethylene.

2 Claims, 2 Drawing Sheets

U.S. PATENT DOCUMENTS

| | | | |
|---|---|---|---|
| 4,732,723 | 3/1988 | Madsen et al. . | |
| 4,769,022 | 9/1988 | Chang et al. . | |
| 4,781,966 | 11/1988 | Taylor | 15/209.1 |
| 4,893,371 | 1/1990 | Hartmann . | |
| 4,911,872 | 3/1990 | Hureau et al. . | |
| 4,948,585 | 8/1990 | Schlein . | |
| 4,969,226 | 11/1990 | Seville . | |
| 4,986,681 | 1/1991 | Oliver . | |
| 4,993,099 | 2/1991 | Emura et al. . | |
| 5,144,744 | 9/1992 | Campagnoli . | |
| 5,187,830 | 2/1993 | Giallourakis . | |
| 5,229,181 | 7/1993 | Daiber et al. . | |
| 5,295,280 | 3/1994 | Hudson et al. . | |
| 5,412,830 | 5/1995 | Girardot et al. . | |
| 5,439,487 | 8/1995 | Stanitzok | 15/209.1 |
| 5,465,452 | 11/1995 | Girardot et al. | 15/209.1 |
| 5,491,864 | 2/1996 | Tuthill et al. . | |
| 5,594,970 | 1/1997 | Benge | 15/208 |

PERSONAL CLEANSING IMPLEMENT MADE OF STRETCHED SCRIM PROVIDING SOFTNESS BENEFIT

FIELD OF THE INVENTION

The present invention relates to plastic scrim (extruded netting), and more particularly to such scrim used for personal cleansing implements wherein the properties of the scrim are tailored to provide a consumer preferred feel designated as softness. Even more particularly, the present invention relates to personal cleansing implements made of diamond mesh tubular scrim wherein the tubular scrim is permanently stretched.

BACKGROUND OF THE INVENTION

A variety of cleansing implements have been used to remove dirt and dead skin from the user's body during bathing or showering. Traditionally, hand held terry washcloths and natural and synthetic sponges have been used. Each of these has one or more significant deficiencies. For example, a sponge has pores which make it difficult to remove dirt from the implement once the dirt is removed from the body. A washcloth often impedes lathering even though lathering is a primary function of a cleansing implement. Some sponges absorb the cleansers that are intended to help remove dirt. Neither sponges nor washcloths can be dried quickly because they become water-logged. As a result they develop unpleasant odors and become a place for breeding bacteria, mold, etc. Also, such implements are typically not suitable for cleaning all body parts. Washcloths are too soft to stimulate and exfoliate skin, and sponges are too rough to cleanse sensitive skin areas.

Ball-like structures made of polymer netting have also been found in the prior art. An example is disclosed in U.S. Pat. No. 5,144,744 to Campagnoli, issued Sep. 8, 1992. Ball-like structures are hand held and are made of diamond-mesh polyethylene. Diamond-mesh polyethylene is an extruded netting (scrim) material which is commonly found covering vegetables, meat, and poultry. Ball-like structures have the disadvantage of having a dense center portion which is effectively wasted material and which may he difficult to rinse and dry.

An improved scrim construction is found in U.S. Pat. No. 5,491,864, issued Feb. 20, 1996 to Tuthill et al. Tuthill et al. has a tubular diamond mesh scrim which is stretched transversely and gathered longitudinally to form pleats, which ate then bonded in place. The resulting implement is substantially flat in shape, but it has significant loft or thickness due to the pleats. A major advantage of the flat implement construction is that it has no dense center portion, and it is therefore easily rinsed and dried.

A cleansing implement construction which has a consumer noticeable softness benefit is desired by consumers. Consumers desire an implement which feels soft or gentle when rubbed against the skin. Some cleansing implements currently in the marketplace are of the ball-like shape and are perceived as lacking the softness benefit. Softness is measurable by a panel of testers who are able to differentiate a soft feel from a scratchy feel and standardize on a repeatable numeric rating system.

U.S. Pat. No. 4,020,208 to Mercer et al., assigned to Netton, Ltd., England, discloses an extruded plastic scrim having mesh openings shaped as hexagons instead of the normal diamond mesh shape. The hexagonal shape is achieved by stretching a standard mesh "to produce a structure which has improved handle in that it is more limp and pliable". "The improvement arises from redistribution of resin at filament intersections (nodes)." Mercer et al. defines his ideal stretched scrim as having a preferred molecular orientation (from stretching) and lengths of nodes which are 3.5 times the diameter of cross-sections of the strands (filaments) between nodes. Although Mercer et al. discloses an approach to what is probably a softer scrim, the primary concern is with strength optimization of plastic scrim.

OBJECTS OF THE INVENTION

It is an object of the present invention to provide a scrim for a personal cleansing implement of the flat style exemplified in U.S. Pat. No. 5,491,864, which has properties that cause the implement to be deemed soft to the feel by consumers, when comparing commercial cleansing implements made of scrim.

It is another object of the present invention to provide a scrim for a personal cleansing implement of the flat style exemplified in U.S. Pat. No. 5,491,864, which has sufficient resilience to maintain its shape and loft during use.

SUMMARY OF THE INVENTION

Diamond mesh scrim is plastic netting made by an extrusion process using counter-rotating die heads, each of which has multiple extrusion orifices located at the edge of each die. The counter rotation of the die heads causes extruded filaments or strands to align in two directions at angles to the machine direction of the extruded tubing. The strands periodically intersect to form nodes. The two strand directions are typically at acute angles to each other, such that strands form diamond patterns with nodes at each corner. U.S. Pat. No. 3,957,565 to Livingston et al. describes this process in more detail.

A tubular section of diamond mesh scrim may be considered a series of repeating units connected together. Each repeating unit has a node connected to two portions of strand. The repeating unit forms a "V" with the node at the vertex and the two strand portions extending therefrom at an acute angle to each other. Nodes represent intersections of strands. Each node has a repeatable length, width, and height. Strands have repeatable lengths between nodes, and they have consistent cross-sectional shapes. The cross-sectional shapes are a function of the die shape in each die head. Typically, diamond mesh scrim is made of polyolefins, most notably polyethylene. Repeat units have a weight, which can be obtained by measuring a piece of tubular scrim and dividing by the number of nodes in the piece.

To measure node dimensions, a piece of scrim is stretched such that the acute angle of each diamond is at least 30°. Node length can be measured from one end of the node to the other along a line which bisects the acute angle of a diamond. Node width can be measured from one side of the node to the other along a line which bisects the obtuse angle of a diamond. Since a node represents an intersection of strands, the minimum width of a node is the diameter of one strand. If the scrim is held flat against a surface, node width and length may be measured parallel to the planar surface. Node width is not to be confused with node height, which is measured perpendicular to the planar surface against which the scrim is placed.

Diamond mesh scrim can be distinguished from square mesh netting. Square mesh netting is made from two reciprocating die heads. Personal cleansing implements may be made from square mash netting, however, because the strands run in machine direction and perpendicular to machine direction, radial or longitudinal stretching or gathering of the scrim is more difficult than with diamond mesh scrim, which has strands running at angles to machine and cross machine directions. U.S. Pat. No. 4,123,491 to Larsen describes a reciprocating die head in more detail.

Personal cleaning implement softness is a consumer perceived quality which is determined by rubbing an implement against one's skin. For implements having a stretched scrim, softness is believed to be the result of reduced resistance to twist at scrim nodes and reduced resistance to bending of scrim strands. That is, flexibility of "repeat units" within the stretched scrim to adapt to body contours, as the implement is rubbed against one's skin, is believed to enhance perceived softness. Softness should be balanced against implement integrity, which is scrim resilience to deformation. It is important that pleats of scrim have enough resilience to conform to body contours without folding over on themselves, and that the pleats return to their original shape after they are deformed in order to provide the same performance over repeated uses. The same variables are believed to define implement resilience as define implement softness. Those variables are: node width, strand length, and repeat unit weight. Smaller nodes, longer strands and lighter repeat unit weights improve softness, whereas larger nodes, shorter strands and heavier repeat unit weights improve resilience. Round cross-section strands have been found to provide the optimum resilience for a given softness in stretched and pleated scrim implements.

In one aspect of the present invention, a personal cleansing implement comprises a hydrophobic piece of tubular scrim. The piece of tubular scrim is stretched laterally and gathered along a longitudinal axis thereof to form circumferential pleats. The circumferential pleats are permanently fixed in a stretched and gathered condition via bonding between a top surface and a bottom surface of them adjacent to their perimeter. The tubular scrim has properties which result in a consumer preferred softness in the personal cleansing implement. The properties of the tubular scrim include a node width ranging from 0.18 mm to 0.56 mm; a strand length ranging from 1.78 mm to 3.68 mm; and a repeat unit average weight ranging from $1.0\times10^{-4}$ gm to $3.4\times10^{-4}$ gm. Although repeat weights lower than $1.0\times10^{-4}$ gm are theoretically possible, any scrim having a repeat unit average weight below $1.25\times10^{-4}$ gm is considered very difficult to process and handle commercially on a counter-rotating die diamond mesh scrim extrusion process. The tubular scrim is preferably made substantially of low density polyethylene. Low density polyethylene is intended to include linear low density polyethylene.

The personal cleansing implement may further comprise quilt-like bonding between the top and the bottom surfaces internal to the perimeter of the circumferential pleats. The quilt-like bonding may occur along a continuous line or at least one spot. The bonding may be thermobonding or stitching.

BRIEF DESCRIPTION OF THE DRAWING

While the specification concludes with claims which particularly point out and distinctly claim the present invention, it is believed that the present invention will be better understood from the following description of preferred embodiments, taken in conjunction with the accompanying drawings, in which like reference numerals identify identical elements and wherein:

DETAILED DESCRIPTION OF THE INVENTION

Figure 1:
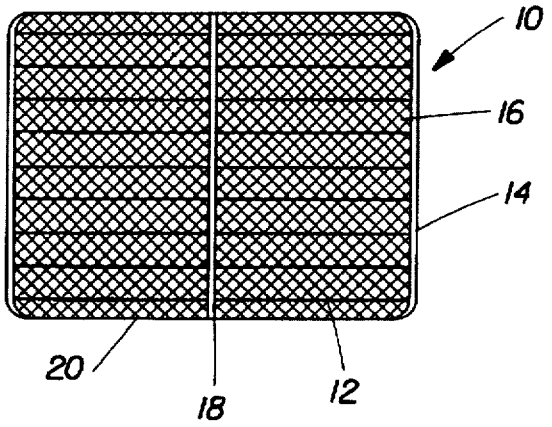
FIG. 1 is a top plan view of a preferred embodiment of the personal cleansing implement made of stretched scrim providing softness benefit of the present invention, disclosing gathered pleats of scrim held together by perimeter and internal bonding.

Referring now to the drawings, and more particularly to FIG. 1, there is shown a first preferred embodiment of the present invention, which provides a personal cleansing implement having a soft scrim, and which is generally indicated as 10. Implement 10 has pleats 12 and perimeter bonds 14, which are made between a top surface 16 of pleats 12 shown and a bottom surface of pleats, not shown. The entire structure of implement 10 is made from a piece of tubular diamond-mesh scrim 20, which is stretched laterally and gathered longitudinally to form circumferential pleats lying atop one another. While stretched and gathered, the pleats are bonded together near their perimeter via stitching or thermobonding. For larger implements, quilt-like spot bonds may be made between top and bottom surfaces of pleats to help stabilize the pleats from rolling over on each other when the implement is used. Alternatively, a continuous line bond 18 down the center of implement 10 is shown in FIG. 1 to serve the same purpose. Although a substantially rectangular implement is shown, any perimeter shape, including round, is feasible.

Figure 4:
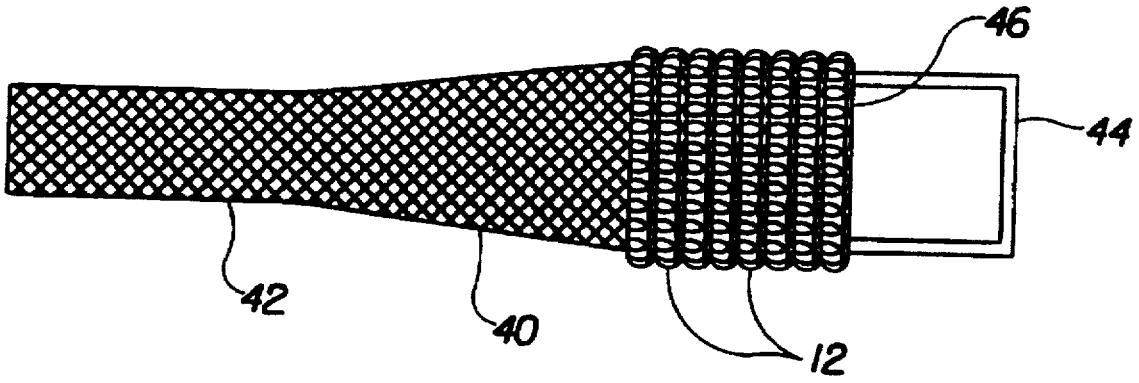
FIG. 4 is a top plan view of another embodiment of the present invention, disclosing a piece of tubular scrim partially pulled onto a wicket wire, the scrim being stretched transversely to its tubular axis and then gathered along that axis to form circumferential pleats, the stretched and pleated tubular scrim forming a substantially flat batt when fully gathered on the wire wicket.
Figure 5:
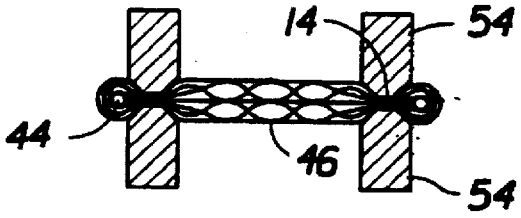
FIG. 5 is a side elevation view thereof, showing bonding tools approaching top and bottom surfaces of the substantially flat batt while the gathered pleats remain on the wicket wire, so that bonds may be formed near the perimeter of the batt to retain the flat, pleated shape after the wicket wire is removed.

The construction of the preferred personal cleansing implement of the present invention is generally in accordance with the teachings of commonly assigned U.S. Pat. No. 5,491,864, issued to Tuthill et al. on Feb. 20, 1996, which is hereby incorporated by reference. FIGS. 4 and 5 show a preferred method of making implement 10. FIG. 4 discloses a piece of diamond-mesh polyethylene scrim tubing 40, which initially has an unstretched condition 42 of about 60 mm diameter. Tubing 40 is pulled over the tapered nose of a planar wire wicket 44 to a width of about 240 mm, in order to elastically stretch the tubing transverse to its longitudinal axis. The result of elastic stretching is that diamond-mesh tubing 40, having diamond acute angles of about 5° in condition 42, is transformed to stretched scrim tubing 46, having more open diamond acute angles of about 45°. The scrim tubing 40 is also gathered along its longitudinal axis to form circumferential pleats 12 in stretched scrim tubing 46. FIG. 5 shows scrim tubing 46 in the jaws of thermobonding dies 54 to form a substantially flat and rectangular batt, which is about 160 mm long and 160 mm wide and 50 mm thick when uncompressed. Dies 54 are heated by a source of heat energy not shown, but which is common in the art. Dies 54 may also be an ultrasonic horn and anvil combination which are not heated, but which generate heat in the material to be sealed. Ultrasonic vibration generation of heat is also commonly known in the art. Dies 54 may also be replaced with a means for stitching the top and bottom surfaces of the batt together. Before the wicket wire is removed, the stretched and pleated scrim may also be heat set to better retain the shape of the batt.

Figure 2:
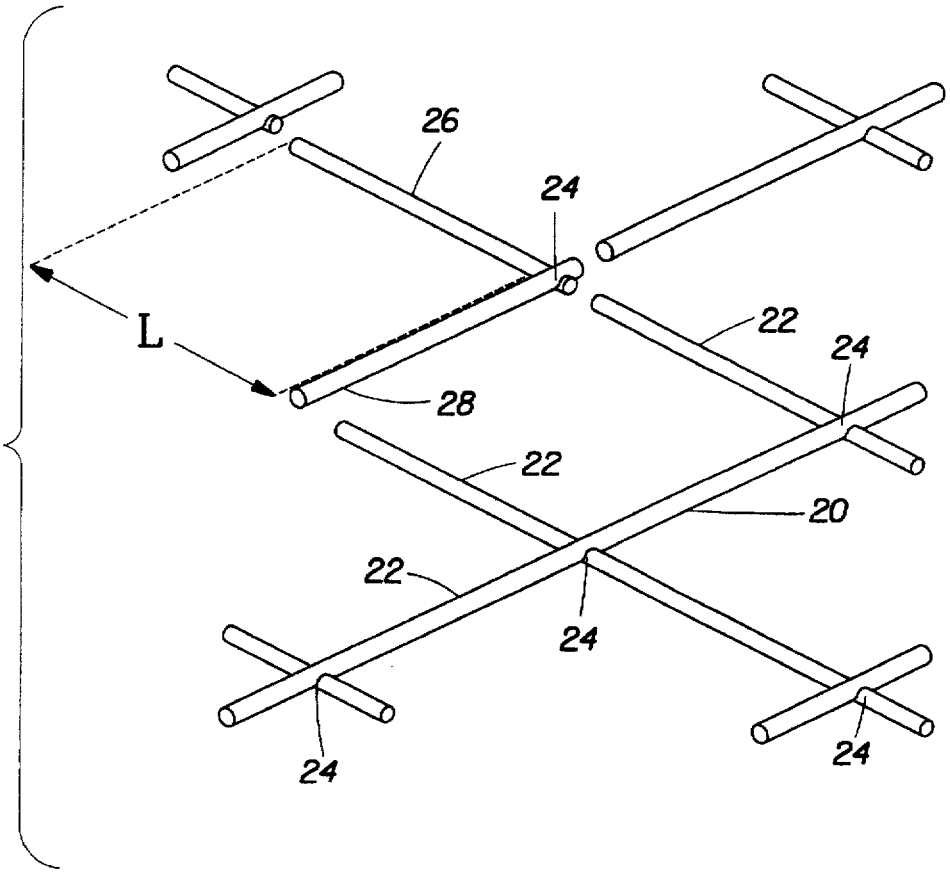
FIG. 2 is a enlarged perspective view of a portion of the scrim thereof, showing a repeat unit.

FIG. 2 shows a portion of stretched and gathered piece of tubular diamond-mesh scrim 20. Scrim 20 has strands 22 and nodes 24 where strands 22 intersect. At nodes 24, strands 22 are melted together. The size of the melted connection is a function of the scrim making process. Strands 22 are preferably circular in cross-section so that they are smooth and have minimal resistance to bending and twisting in any direction. FIG. 2 also shows a portion of scrim 20 separated from the scrim piece to represent a repeat unit 26. Repeat unit 26 has two lengths of strand 28 attached to a node 30. Each length of strand 28 has a length L, which is the length between nodes.

Figure 3:
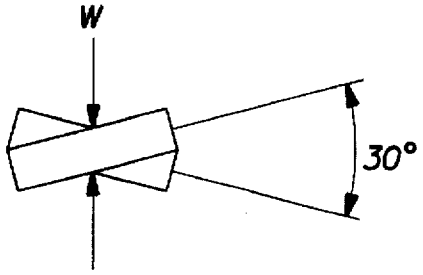
FIG. 3 is an even more enlarged top plan view of a portion of the scrim thereof, showing a node and the location where the width dimension is measured.

FIG. 3 shows node 30, which is formed by the intersection of strands 28 and comprises only the intersection portion. Looking down at a piece of scrim lying flat against a surface and stretched, such that at least a 30° angle exists between strands 28, enables one to measure the width W of node 30. Width W is essentially the narrowest dimension of node 30 measured parallel to the surface upon which the scrim is placed.

Each repeat unit 26 has an average weight which may be determined by weighing a large piece of scrim and dividing that weight by the number of nodes counted within the piece of scrim.

Researchers have determined empirically that measuring a strand length L and a node width W of a scrim repeat unit 26, combined with a measurement of an average weight of repeat unit 26, is sufficient to establish whether or not a piece of tubular scrim will be perceived as soft when used in a flat, pleated, personal cleansing implement. It is believed that when these measurements are all in the desired ranges, the scrim will he resiliently deformable while strands will have a low resistance to bending and twisting, and therefore offer minimal resistance to drag across an implement user's skin. Such low resistance to drag and compliance are identifiable with perceived softness.

In a particularly preferred embodiment of the present invention, node width W ranges from 0.18 mm to 0.56 mm; strand length L ranges from 1.78 mm to 3.68 mm; and repeat unit average weight ranges from $1.0\times10^{-4}$ gm to $3.4\times10^{-4}$ gm. Even more preferably, strand length L is about 2.54 mm, node width W is about 0.25 mm, and repeat unit average weight is about $1.7\times10^{-4}$ gm. Although there are three ranges for three variables, the ranges are not totally independent. That is, when the values for L and W are at the low ends of their ranges, the value for average weight would be at the low end of its range in order for maximum softness to result. If the values for L and W are at the high ends of their ranges, the value for average weight would be at the high end of its range for optimum resilience to result. If L is high and W is low, it would be expected that optimum resilience would occur at the upper half of the average weight range. If L is low and W is high, it would be expected that maximum softness would occur at the lower half of the weight range.

The preferred scrim is made substantially of low density polyethylene. Other polymer materials, such as ethylene vinyl acetate and high density polyethylene, may be blended with low density polyethylene to adjust scrim resilience for a given set of L, W, and average repeat unit weight. Such tubular diamond-mesh scrim may be obtained from Conwed Corporation of Minneapolis, Minn., as specification No. 960104-1.

While particular embodiments of the present invention have been illustrated and described, it will be obvious to those skilled in the art that various changes and modifications may be made without departing from the spirit and scope of the invention, and it is intended to cover in the appended claims all such modifications that are within the scope of the invention.

What is claimed is:

1. An improved personal cleansing implement of the type made from a piece of tubular scrim which is made substantially of low density polyethylene and is stretched laterally and gathered along a longitudinal axis to form circumferential pleats which are then permanently fixed in a stretched and gathered condition to form a substantially flat implement, said piece of tubular scrim having properties comprising:

a) a node width ranging from 0.18 mm to 0.64 mm;

b) a strand length ranging from 1.78 mm to 3.56 mm; and c) a repeat unit weight ranging from $1.0\times10^{-4}$ gm to $3.7\times10^{-4}$ gm, said properties resulting in a consumer preferred softness and resilience in said personal cleansing implement.

2. An improved personal cleansing implement of the type made from a piece of tubular scrim which is made substantially of low density polyethylene and is stretched laterally and gathered along a longitudinal axis to form circumferential pleats which are then permanently fixed in a stretched and gathered condition to form a substantially flat implement, said piece of tubular scrim having properties comprising:

a) node width of about 0.25 mm;

b) a strand length of about 2.54 mm; and c) a repeat unit weight of about $1.7\times10^{-4}$ gm, said properties resulting in a consumer preferred softness and resilience in said personal cleansing implement.

* * * * *